US011184725B2

(12) United States Patent
Arroyo

(10) Patent No.: US 11,184,725 B2
(45) Date of Patent: Nov. 23, 2021

(54) METHOD AND SYSTEM FOR AUTONOMOUS BOUNDARY DETECTION FOR SPEAKERS

(71) Applicant: Samsung Electronics Co., Ltd., Suwon-si (KR)

(72) Inventor: Adrian Celestinos Arroyo, Porter Ranch, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/370,160

(22) Filed: Mar. 29, 2019

(65) Prior Publication Data

US 2020/0112807 A1 Apr. 9, 2020

Related U.S. Application Data

(60) Provisional application No. 62/743,171, filed on Oct. 9, 2018.

(51) Int. Cl.
*H04R 29/00* (2006.01)
*H04R 3/04* (2006.01)

(52) U.S. Cl.
CPC ..... *H04R 29/001* (2013.01); *H04R 3/04* (2013.01)

(58) Field of Classification Search
CPC .... H04R 27/00; H04R 3/005; H04R 2430/20; H04R 2499/13; H04R 3/00; H04R 3/04; H04R 19/04; H04R 19/016; H04R 1/08; H04R 1/326; H04R 1/406; H04R 2410/03; H04R 2205/024; H04R 2227/003; H04R 29/00; H04R 29/001; H04R 3/12; H04R 5/04; H04R 2225/43; H04R 2420/07; H04R 2499/11; H04R 25/552; H04R 25/554; H04R 3/14; H04R 1/00; H04R 1/025;
(Continued)

(56) References Cited

U.S. PATENT DOCUMENTS 5,848,169 A * 12/1998 Clark, Jr. ..... G10K 11/17875 381/71.13
6,731,760 B2 * 5/2004 Pedersen ..... H04R 3/04 381/59
(Continued)

FOREIGN PATENT DOCUMENTS

JP 2009147812 A 7/2009
KR 20160000466 A 1/2016
(Continued)

OTHER PUBLICATIONS

Farina, A., "Simultaneous measurement of impulse response and distortion with a swept-sine technique." Audio Engineering Society Convention 108, Feb. 1, 2000, pp. 1-24, Audio Engineering Society, United States.
(Continued)

*Primary Examiner* — Lun-See Lao
(74) *Attorney, Agent, or Firm* — Sherman IP LLP; Kenneth L. Sherman; Hemavathy Perumal

(57) ABSTRACT

A method includes detecting, by a speaker system including a microphone, one or more boundaries within a proximity to the speaker system. The speaker system adjusts an output of the speaker system based on the one or more detected boundaries. A sound quality of the speaker system is improved based on adjusting the output.

20 Claims, 11 Drawing Sheets

(58) Field of Classification Search
CPC ..... H04R 1/24; H04R 1/26; H04R 1/2803; H04R 1/288; H04R 1/2888; H04R 2201/029; H04R 2201/401; H04R 2400/01; H04R 25/407; H04R 25/43; H04R 29/004; H04R 5/02; H04R 5/027; H04R 2201/003; H04R 2225/41; H04R 2430/03; H04R 25/305; H04R 25/405; H04R 25/558; H04R 25/70; H04R 29/006; H04R 3/007
USPC ..... 381/56–58, 103–107, 86, 92
See application file for complete search history.

(56) References Cited

U.S. PATENT DOCUMENTS

| | | | | |
|---|---|---|---|---|
| 7,933,421 | B2 | 4/2011 | Asada | |
| 8,290,185 | B2 | 10/2012 | Kim | |
| 8,401,202 | B2 | 3/2013 | Brooking | |
| 9,215,542 | B2 | 12/2015 | Silzle et al. | |
| 9,264,834 | B2 | 2/2016 | Arthur et al. | |
| 9,338,549 | B2 * | 5/2016 | Haulick | G01S 7/52003 |
| 9,562,970 | B2 | 2/2017 | Ojala et al. | |
| 9,949,050 | B2 | 4/2018 | Dokmanic et al. | |
| 10,024,712 | B2 | 7/2018 | Barjatia et al. | |
| 10,062,372 | B1 | 8/2018 | Barton et al. | |
| 10,089,062 | B2 | 10/2018 | Lee et al. | |
| 10,264,380 | B2 * | 4/2019 | Salume | G06T 17/05 |
| 10,516,957 | B2 * | 12/2019 | Russell | H04R 9/025 |
| 2006/0136544 | A1 * | 6/2006 | Atsmon | A63H 3/28 709/200 |
| 2011/0194719 | A1 * | 8/2011 | Frater | H04R 27/00 381/332 |
| 2014/0341394 | A1 * | 11/2014 | Croft, III | H04R 3/04 381/102 |
| 2015/0316820 | A1 * | 11/2015 | Duston | G02B 30/00 349/138 |
| 2015/0332680 | A1 * | 11/2015 | Crockett | G10L 19/008 381/23 |
| 2016/0192090 | A1 * | 6/2016 | Gran | H04R 25/552 381/23.1 |
| 2017/0070822 | A1 | 3/2017 | Skovenborg | |
| 2017/0085233 | A1 * | 3/2017 | Berkhout | H03F 3/187 |
| 2018/0139560 | A1 * | 5/2018 | Shi | H04R 3/005 |
| 2018/0146281 | A1 | 5/2018 | Spero | |
| 2018/0158446 | A1 * | 6/2018 | Miyamoto | H04N 7/183 |
| 2018/0352324 | A1 * | 12/2018 | Choisel | H04R 1/403 |
| 2020/0014416 | A1 * | 1/2020 | Bayart | H04B 1/406 |
| 2020/0105291 | A1 * | 4/2020 | Sheaffer | G10L 21/10 |

FOREIGN PATENT DOCUMENTS

| | | | |
|---|---|---|---|
| KR | 20170041323 | A | 4/2017 |
| WO | 2013-006323 | A2 | 1/2013 |

OTHER PUBLICATIONS

Rife, D.D. et al., "Transfer-Function Measurement with Maximum-Length Sequences," AES E-Library, Jun. 1, 1989, pp. 419-444, v. 37, issue 6, United States.

Orfanidis, S. J., "Optimum signal processing: an introduction," 1996, pp. 41-45, 75-76, 2nd Edition, Macmillan publishing company, Englewood Cliffs, NJ.

Stoica, P. et al., "Spectral analysis of signals." 2005, pp. 1-447, Prentice Hall, Upper Saddle River, NJ.

International Search Report and Written Opinion dated Jan. 17, 2020 for International Application PCT/KR2019/013220 from Korean Intellectual Property Office, pp. 1-9, Republic of Korea.

* cited by examiner

500

400

600

900

1030

1200

1400

1300

METHOD AND SYSTEM FOR AUTONOMOUS BOUNDARY DETECTION FOR SPEAKERS

CROSS-REFERENCE TO RELATED APPLICATIONS

This application claims the priority benefit of U.S. Provisional Patent Application Ser. No. 62/743,171, filed Oct. 9, 2018, which is incorporated herein by reference in its entirety

TECHNICAL FIELD

One or more embodiments relate generally to loudspeaker acoustics, and in particular, a method and system for autonomous boundary detection for adaptive speaker output.

BACKGROUND

Nearby boundaries (e.g., walls, objects, floors, shelves, etc.) affect the response of speakers, especially for compact loudspeakers, television (TV) speakers and soundbars. The proximity of a hard surface can deteriorate the response of a speaker and the sound quality.

SUMMARY

Some embodiments provide a method including detecting, by a microphone, such as a microphone included in the speaker system, one or more boundaries within a proximity to the speaker system. The speaker system adjusts an output of the speaker system based on the one or more detected boundaries. A sound quality of the speaker system is improved based on adjusting the output.

In one or more embodiments, a loudspeaker device includes a speaker driver including a diaphragm, a microphone disposed in proximity of the diaphragm, a memory storing instructions, and at least one processor that executes the instructions to: detect one or more boundaries within a proximity to the loudspeaker device; adjust an output of the speaker device based on the one or more detected boundaries; and improve a sound quality of the speaker device based on adjusting the output.

Some embodiments provide a non-transitory processor-readable medium that includes a program that when executed by a processor performs a method that includes detecting, by the processor, one or more boundaries within a proximity to a speaker system including a microphone. The processor adjusts an output of the speaker system based on the one or more detected boundaries. A sound quality of the speaker system is improved based on adjusting the output.

These and other features, aspects and advantages of the one or more embodiments will become understood with reference to the following description, appended claims, and accompanying figures.

BRIEF DESCRIPTION OF THE DRAWINGS

FIG. 15 is a block diagram for a process for autonomous boundary detection for speakers, in accordance with some embodiments; and FIG. 16 is a high-level block diagram showing an information processing system comprising a computer system useful for implementing various disclosed embodiments.

DETAILED DESCRIPTION

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One or more embodiments relate generally to loudspeakers, and in particular, a method and system for autonomous boundary detection for adaptive speaker output. One embodiment provides a method that include detecting, by a speaker system, including a microphone, one or more boundaries within a proximity to the speaker system. The speaker system adjusts an output of the speaker system based on the one or more detected boundaries. A sound quality of the speaker system is improved based on adjusting the output.

For expository purposes, the terms "loudspeaker," "loudspeaker device," "loudspeaker system," "speaker," "speaker device," and "speaker system" may be used interchangeably in this specification.

In some instances, a boundary near a speaker negatively affects the response of the speaker. For example, with compact loudspeakers, TV speakers, and sound bars, etc., the presence of a hard surface near a speaker can deteriorate or otherwise negatively affect the response and/or sound quality of the speaker. Accordingly, it can be advantageous to understand, recognize, and/or identify the nearby surroundings (e.g., one or more boundaries) of the speaker to adapt its response and maintain optimal sound quality. Some embodiments consider the nearby surroundings of a loudspeaker to adapt its response and maintain optimal sound quality. The speaker addresses the detection of the nearby boundaries (e.g., walls, table, shelf, etc.) and adjusts the output of the speaker to adapt to the surroundings. Some embodiments include determining the impulse response (IR) in the nearfield to detect the magnitude and distance of the closest one or more sound wave reflections and determine if the speaker is positioned, for example, on a table, close to a wall, close to a two-wall corner, close to a three-wall corner, etc. These indications are used to determine compensation, such as a pre-set or equalizer (EQ) tuning that the speaker will use to maintain optimal sound quality. In one example, the disclosed technology can compensate for the negative effects on a loudspeaker caused by nearby boundaries, from 200 Hz to 20 kHz. The speaker device includes autonomous processing such that there is no need for user interaction with the speaker device.

Figure 1B:
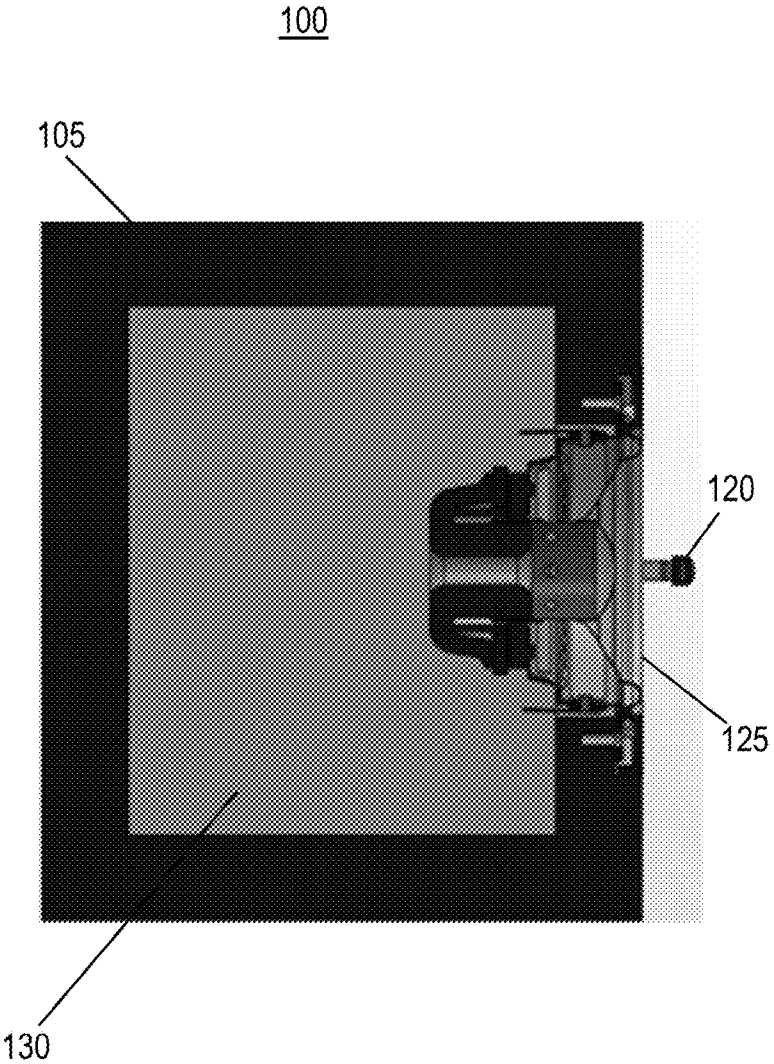
FIG. 1B shows a side view of the example compact loudspeaker including a microphone in front of a diaphragm, according to some embodiments.
Figure 1A:
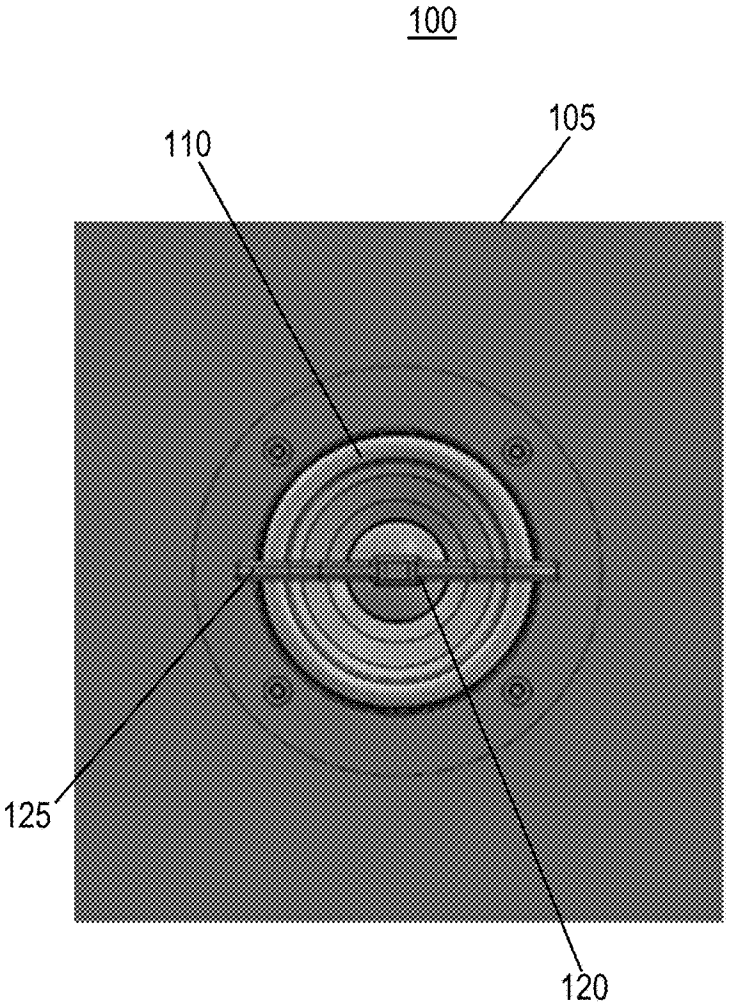
FIG. 1A shows a front view of an example compact loudspeaker including a microphone in front of a diaphragm, according to some embodiments.

FIG. 1A shows a front view and FIG. 1B shows a side view (within an example enclosure 105) of an example compact loudspeaker 100 including a microphone 120 in front of or within close proximity to a diaphragm 110, according to some embodiments. In one example, the loudspeaker 100 includes at least one speaker driver for reproducing sound. The speaker driver includes one or more moving components, such as the diaphragm 110 (e.g., a cone-shaped, flat, etc., diaphragm), a driver voice coil, a former, a protective cap (e.g., a dome-shaped dust cap, etc.). The internal cavity 130 of the enclosure 105 shows the example compact loudspeaker 100 components. The speaker driver may further include one or more of the following components: (1) a surround roll (e.g., suspension roll), (2) a basket, (3) a top plate, (4) a magnet, (5) a bottom plate, (6) a pole piece, (7) a spider, etc.

In some embodiments, the speaker 100 may be constructed using, for example, a 50 mm driver speaker mounted in, for example, a 148×138×126 mm rectangular closed box 105. A microphone 120 (e.g., miniature microphone, a microphone array, etc.) may be mounted, for example, 15 mm in front of the driver's diaphragm with a fixture 125 (e.g., a bar, a bridge, etc. made of, for example, metal, a metal alloy, plastic, etc.). In some embodiments, the speaker 100, may include, but is not limited to the following processing components, the microphone 120 (e.g., a miniature microphone), a microphone pre-amplifier, an analog-to-digital (A/D) converter, and a digital signal processing (DSP) board. In some embodiments, the microphone 120 may be located as close as possible to the speaker 100 diaphragm 110. In some embodiments, the processing components of the speaker 100 operate based on an input signal to the speaker 100, and do not require external power.

Figure 2:
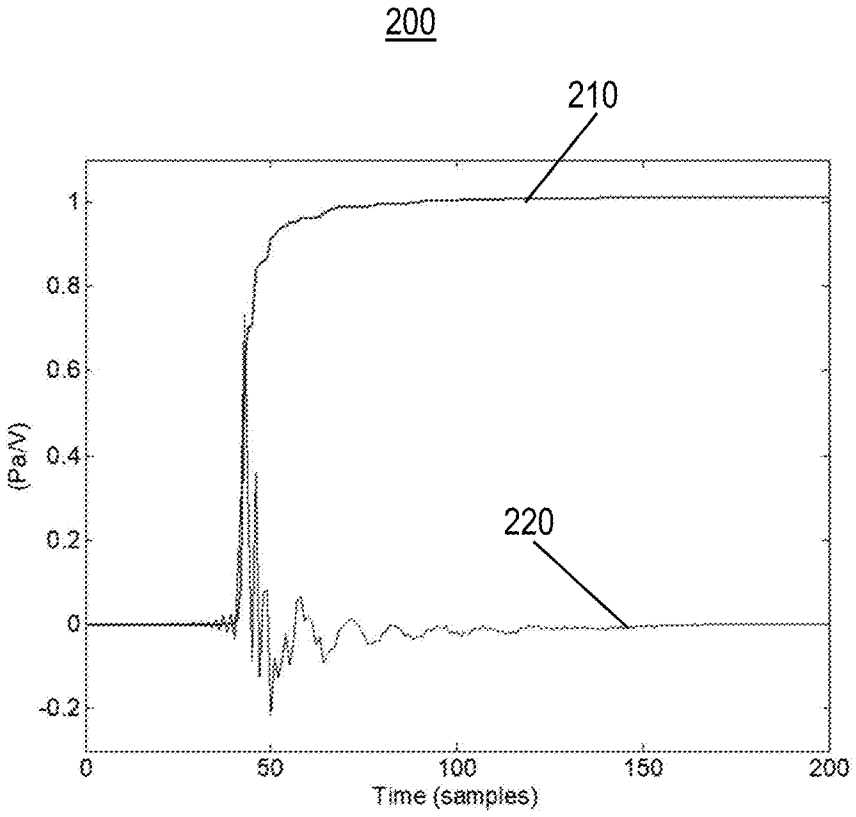
FIG. 2 shows an example graph of samples for impulse response (IR) s(t) and cumulative sum of s(t)

FIG. 2 shows an example graph 200 of samples for IR, s(t) 210, and cumulative sum of s(t) 220. In some cases, a transfer function measurement to compute the IR in a near field of the speaker driver's diaphragm is performed. This measurement can be computed in free field conditions (e.g., in an anechoic chamber), and is referred to herein as s(t). This measurement can be performed or conducted using techniques such as logarithmic sweeps or maximum length sequences (MLS). The variable t represents time in samples or seconds, in the digital domain discretized according to the sampling of the frequency Fs. The IR s(t) is stored in the memory system device.

Figure 3:
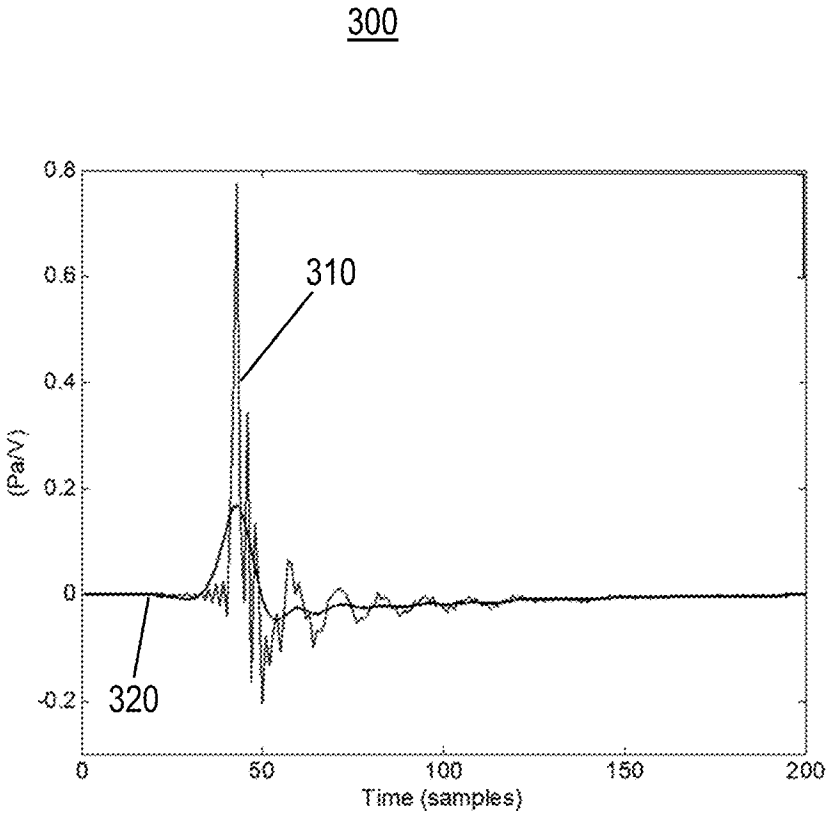
FIG. 3 shows an example graph of samples for an IR measurement, h(t), facilitated by a near field microphone in a near field of a speaker driver's diaphragm and h(t) after zero-phase low-pass filtering, according to some embodiments.

FIG. 3 shows an example graph 300 of samples for an IR measurement, h(t) 310, facilitated by a near field microphone 120 (FIGS. 1A-B) in a near field of a speaker driver's diaphragm and h(t) 320 after zero-phase low-pass filtering, according to some embodiments. In some embodiments, when a user places the speaker 100 (FIGS. 1A-B) in a room and turns the speaker 100 on, an automatic adjustment process is performed by the processing components. This process includes another IR measurement, h(t), facilitated by the near field microphone 120 (FIGS. 1A-B). Acoustic reflections (i.e., sound wave reflections) can be found directly by direct inspection of the IR; in the case of a near field IR, it can be challenging to differentiate what is part of the edge box diffraction, what is part of the speaker response, and what is a reflection of sound from a nearby boundary. One or more embodiments provide processing to find potential nearby boundaries and adjust the speaker 100 output according to the surroundings. After acquiring s(t) 210 and h(t) 310 some embodiments proceed as follows. In some embodiments, for both IRs, s(t) and h(t), the propagation delay $\Delta s$ and $\Delta h$ are found by computing the cumulative sum of each IR, then defining the start of each IR when the cumulative sum reaches 0.1% of its maximum value (see FIG. 2). Once both propagation delays are found, h(t) 310 is aligned in time if necessary, by performing a circular shift using s(t) 210 as a reference. In some embodiments, the two IRs s(t) and h(t) can be low-pass filtered utilizing a second order, zero-phase, or regular, digital filter with a typical cut-off frequency in the range of approximately 1000 Hz to 2500 Hz.

Figure 4:
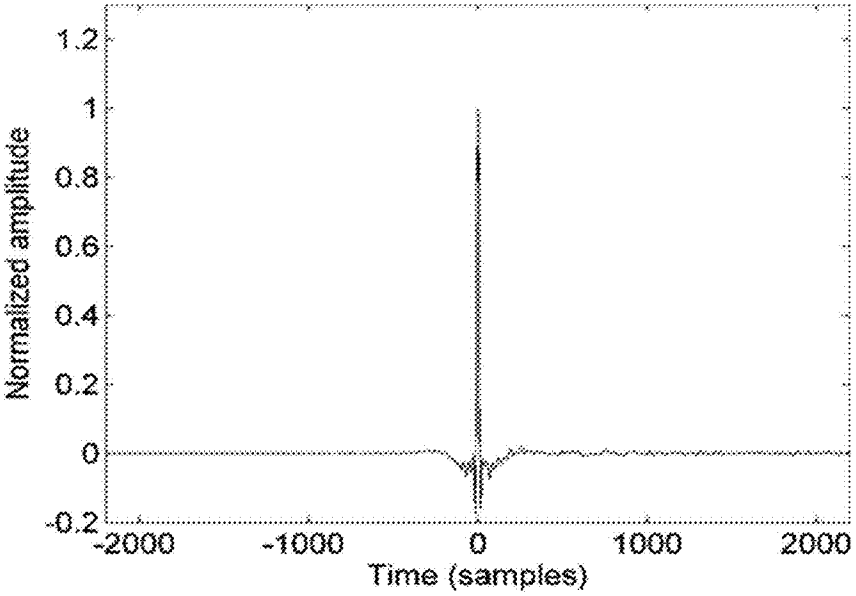
FIG. 4 shows an example graph of a resulting output vector c(m) of cross-correlation between s(t) and h(t), according to some embodiments.

FIG. 4 shows an example graph 400 of a resulting output vector c(m) of cross-correlation between s(t) and h(t), according to some embodiments. In some embodiments, the speaker 100 processing further computes a cross-correlation process between s(t) and h(t) (see Eq. 1). The resulting output vector c(m) may be normalized so that the autocorrelations at zero lag are identically 1.0 (see FIG. 4). The true cross-correlation sequence of two jointly stationary random processes, $x_n$ and $y_n$, is given by $$R_{xy}(m)=E\{x_{n+m}y^*_n\}=E\{x_n y^*_{n-m}\}$$

where $-\infty<n<\infty$, the asterisk denotes complex conjugation, and E is the expected value operator. In this case $x_n$ is represented by $h_n$, and $y_n$ is represented by $s_n$. The raw correlations $\widehat{R_{hs}}(m)$ with no normalization are given by $$\widehat{R_{hs}}(m)\begin{cases}\sum_{n=0}^{N-m-1} h_{n+m}s^*_n, & m \geq 0\\ \widehat{R^*_{sh}}(-m), & m<0\end{cases} \quad \text{Eq. 1}$$

The output vector c(m) has elements given by $$c(m)=R_{hs}(m-N),\ m=1,2,\ldots,2N-1$$

Where m is an integer and represents an index, N is the length of the impulse response h and s.

Figure 5:
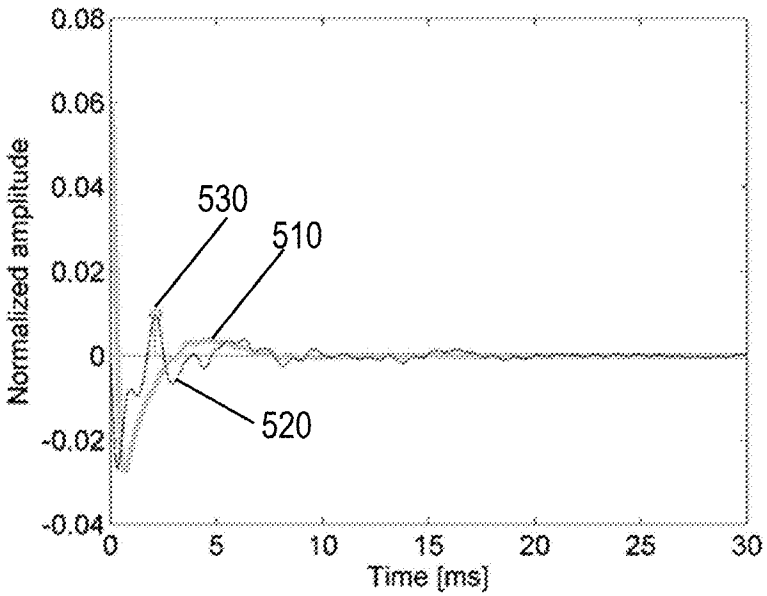
FIG. 5 shows an example graph of a h(t), a vector of reflections r(t) and a found reflection, according to some embodiments.

FIG. 5 shows an example graph 500 of a h(t) 510, a vector of reflections r(t) 520 and a found (i.e., detected, identified, determined, etc.) reflection 530, according to some embodiments. Subsequently, the section of vector c(m), from index m=−N to m=0, can be reversed and subtracted from the c(m) from index m=0 to m=N, as detailed in Eq. 2.

$$c_{reversed}=c(0,-1,-2,\ldots,-N)$$

$$r=c(0:N)-c_{reversed} \quad \text{Eq. 2}$$

Figure 6:
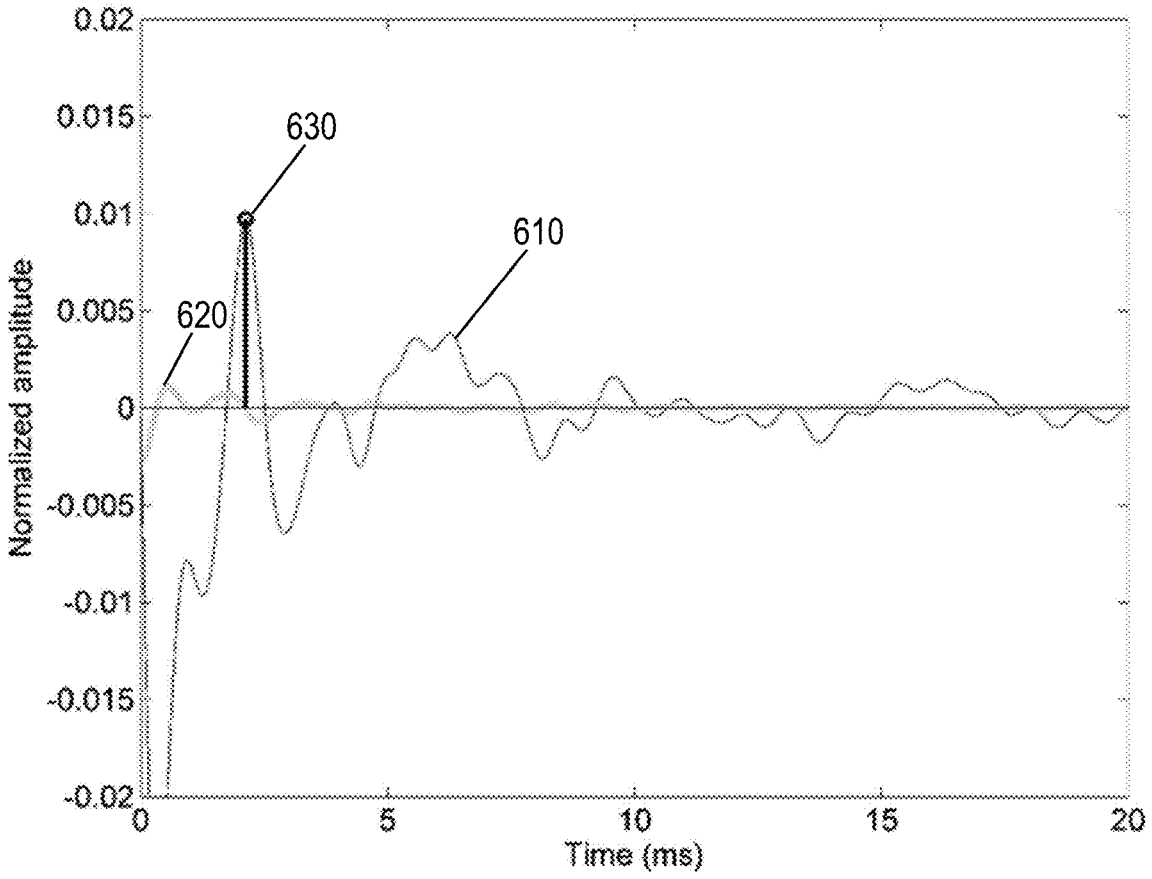
FIG. 6 shows an example graph of r(t), a derivative of r(t) and a found peak $r_1$, according to some embodiments.

FIG. 6 shows an example graph 600 of r(t) 610, a derivative of r(t) 620 and a found peak $r_1$ 630 (at 2.16 ms), according to some embodiments. In some implementations, by inspecting the vector r(t) 520 (in FIG. 5), a prominent peak ($r_1$ 630) can be detected near 2 ms. In this example, the compact speaker 100 (FIGS. 1A-B) is placed in a 2π chamber (e.g., an anechoic room, with only one hard wall behind the speaker 100) and the distance between the speaker diaphragm 110 (FIGS. 1A-B) and the boundary (e.g., the hard wall) is 30 cm.

Figure 7B:
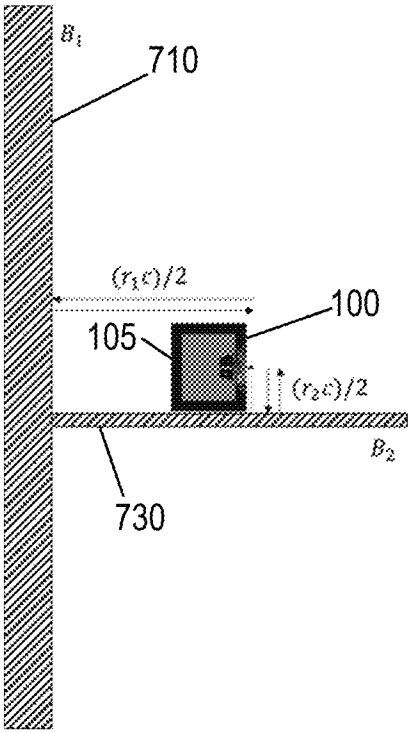
FIG. 7B shows another example setup of a compact loudspeaker in a 2 chamber with one boundary behind the loudspeaker and another boundary underneath the loudspeaker, according to some embodiments.
Figure 7A:
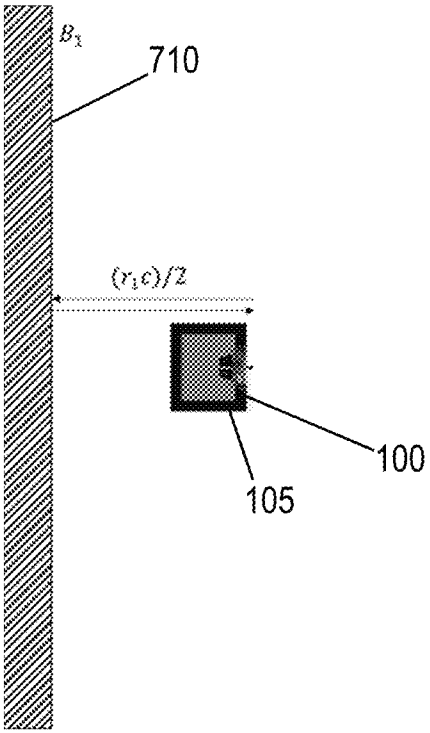
FIG. 7A shows an example setup of a compact loudspeaker in a $2\pi$ chamber with only one boundary behind the loudspeaker, according to some embodiments.

FIG. 7A shows an example setup (setup 1) of a compact loudspeaker 100 in a 2π chamber with only one boundary $B_1$ 710 behind the loudspeaker 100, according to some embodiments. In some cases, the peaks can be found or determined by calculating the derivative of r(t). A peak can be found when a change in sign is detected. A threshold value can be set, such that a peak larger than the threshold value is recognized as a reflection. A determined limit of peaks can be introduced as well as a time span limit to detect reflections. A reflection $r_1$ is found at 2.16 ms. By using Eq. 3, where c=343 m/s (the speed of sound in air), a potential boundary $B_1$ 710 can be found at 0.37 m. The actual boundary is at 0.30 m from the edge of the speaker box 105. The 0.07 m error is attributed to the time that sound waves diffract around the speaker 100, the sampling error, and/or the microphone's placement at 0.015 m from the driver's diaphragm. $r_1$=2.16 ms $$B_1=\frac{r_1 c}{2} \quad \text{Eq. 3}$$

FIG. 7B shows another example setup (setup 2) of a compact loudspeaker 100 in a 2π chamber with one boundary $B_1$ 710 behind the loudspeaker and another boundary $B_2$ 730 underneath the loudspeaker, according to some embodiments. In setup 2, the boundary $B_1$ 710 is 0.30 m behind the speaker box 105. The table boundary $B_2$ 730 is placed below the speaker 100 where the distance from the surface of the table boundary $B_2$ 730 to the center of the speaker box 105 is 0.05 m.

Figure 8B:
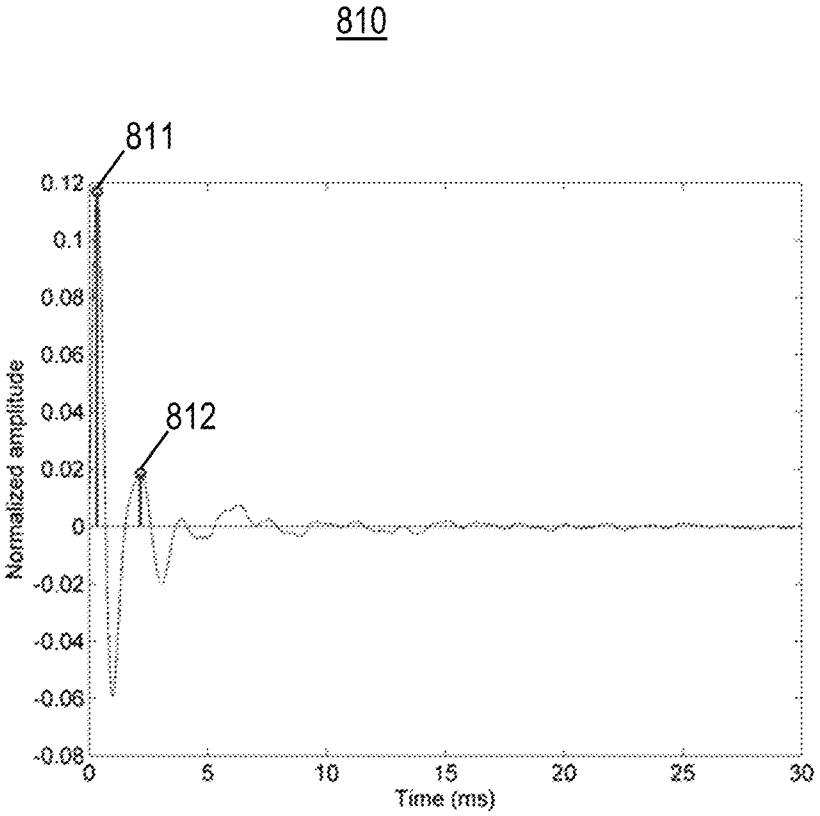
FIG. 8B shows an example graph of r(t), a derivative of r(t) and a found peak $r_1$ reflection for the setup shown in FIG. 7B, according to some embodiments.
Figure 8A:
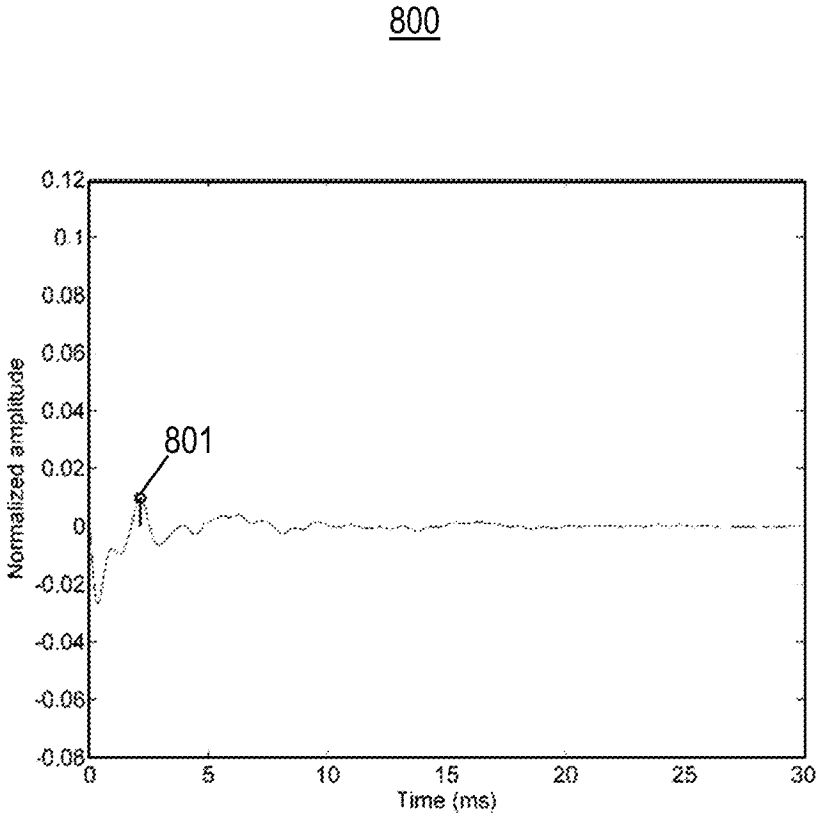
FIG. 8A shows an example graph of r(t), a derivative of r(t) and a found peak $r_1$ reflection for the setup shown in FIG. 7A, according to some embodiments.

FIG. 8A shows an example graph 800 of r(t), a derivative of r(t) and a found peak $r_1$ 801 reflection for the setup 1 shown in FIG. 7A, according to some embodiments. In graph 800 the reflection is detected at 2.16 ms.

FIG. 8B shows an example graph 810 of r(t), a derivative of r(t) and a found peak $r_1$ 812 reflection for the setup 2 shown in FIG. 7B, according to some embodiments. In setup 2, reflection 811 is detected at 0.33 ms, and reflection 812 is detected at 2.16 ms. The speaker 100 processing identifies the reflection 811 at 0.33 ms and the reflection 812 at 2.16 ms, corresponding to potential boundaries at 0.06 m and 0.37 m, respectively. By using a sampling rate Fs=48000 Hz, a detection error can be expected due to a sampling of ±0.0071 m, according to Eq. 4.

$$\text{error}_{sampling}=\frac{c}{Fs}\ \text{meters} \quad \text{Eq. 4}$$

Figure 9:
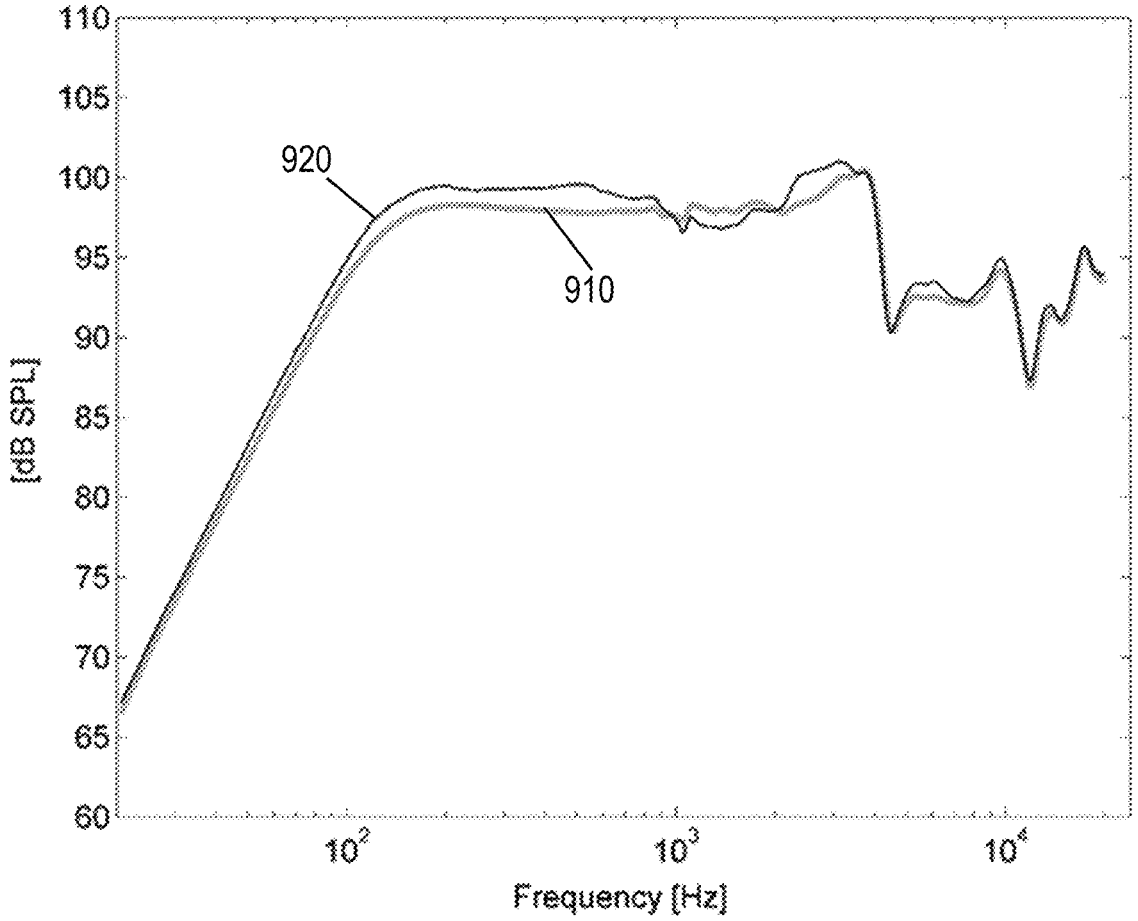
FIG. 9 shows an example graph of sound pressure level measurement at a near field microphone including a free field response S and at $2\pi$ a space response H, according to some embodiments.

FIG. 9 shows an example graph 900 of sound pressure level (SPL) measurement at a near field microphone including a free field response S 910 and the 2π space response H 920, according to some embodiments. For some embodiments, assuming that the speaker 100 (FIGS. 1A-B) will be placed most of the time on its base, with an orientation towards the listener(s), it can be inferred, predicted, and/or determined whether the speaker is on a table or free-standing. If the detected reflection $r_n$ is larger than 25% of the maximum amplitude of h(t), the speaker 100 is most likely on a table. In some embodiments, to facilitate an estimation of speaker 100 proximity to a wall/boundary, a fast Fourier transform is computed on s(t) and h(t), (see Eq. 5 and Eq. 6), to compute an SPL in the near field, where pref is the reference pressure in air and pref=20 μPa. Then, in some embodiments Eq. 7 is used to compute the differences in SPL along discrete frequencies from $f_1$ to $f_2$ (typically from $f_1$=20 Hz to $f_2$=500 Hz).

$$S=20\log_{10}\frac{fft(s(t))}{pref} \quad \text{Eq. 5}$$

$$H=20\log_{10}\frac{fft(h(t))}{pref} \quad \text{Eq. 6}$$

$$SPL_{diff}=\sqrt{(H(f_1:f_2)-S(f_1:f_2))^2} \quad \text{Eq. 7}$$

In some embodiments, the speaker 100 processing provides the following determinations or computations, which are used to identify, predict, and/or estimate the position of the speaker with respect to one or more nearby boundaries:

- If 0.4 dB>$SPL_{diff}$ then the speaker is determined to be free standing.
- If 0.4 dB>$SPL_{diff}$<1.5 dB then the speaker is determined to be close to a wall.
- If 1.5 dB>$SPL_{diff}$<5 dB then the speaker is determined to be close to a two-wall corner.
- If 5 dB>$SPL_{diff}$ then the speaker is determined to be close to a three-wall corner.

Figure 10A:
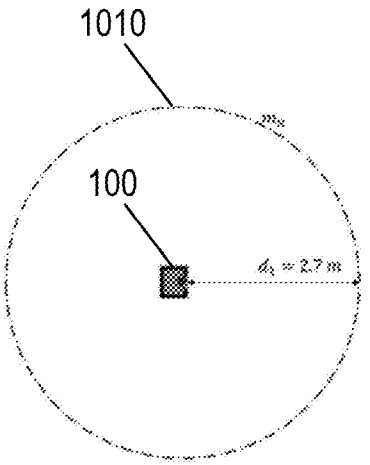
FIG. 10A shows an example of distribution of microphones, horizontal and vertical positions relative to a loudspeaker for a near field microphone, according to some embodiments.
Figure 10B:
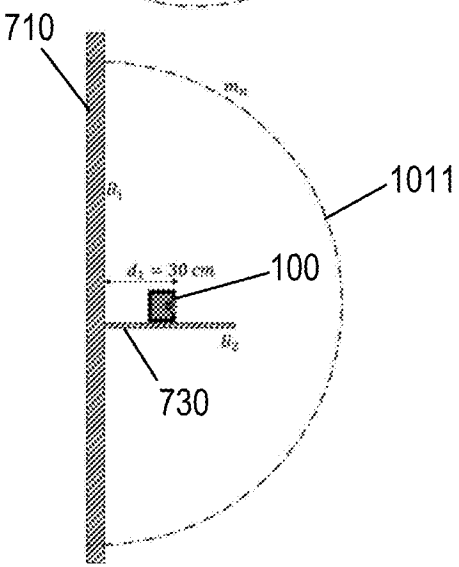
FIG. 10B shows an example of half sphere distribution of microphone positions relative to a loudspeaker and boundaries for a near field microphone, according to some embodiments.

FIG. 10A shows an example of distribution of microphones, horizontal and vertical positions 1010 relative to a loudspeaker 100 for a near field microphone 120 (FIGS. 1A-B), according to some embodiments. FIG. 10B shows an example of half sphere 1011 distribution of microphone positions relative to the loudspeaker 100 and boundaries (boundary $B_1$ 710, boundary $B_2$ 730) for a near field microphone, according to some embodiments. The distance from the front of the speaker 100 to the boundary $B_1$ 710 is 30 cm. Sound power measured in free field compared with 2π space. A table is added in the 2π space.

Figure 10C:
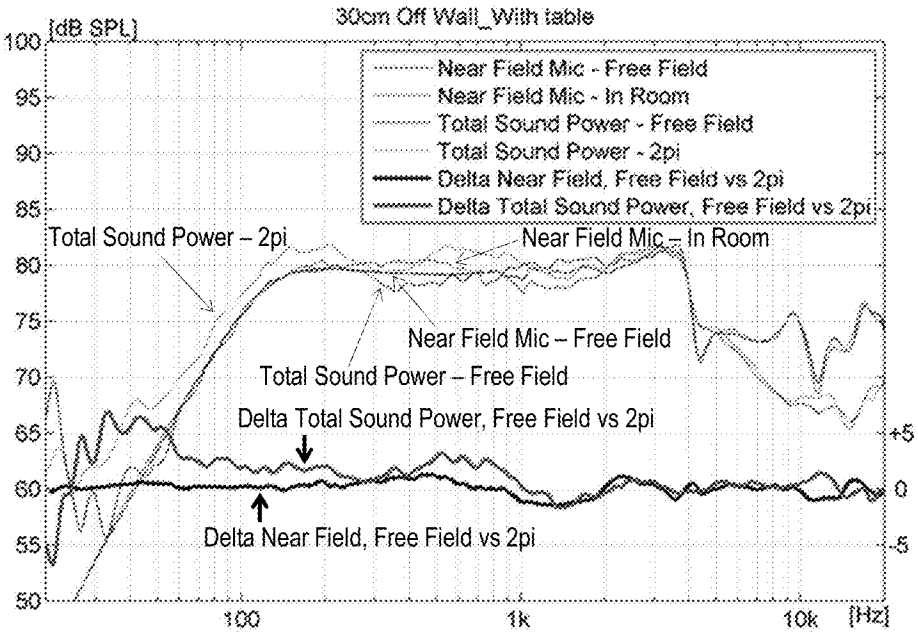
FIG. 10C shows example graphs for responses for the setup shown in FIGS. 10A and 10B according to some embodiments.

FIG. 10C shows example graphs 1030 for responses for the setup shown in FIG. 10B, according to some embodiments. The near field measurement provides an indication of the effect of nearby boundaries on the total sound power in the entire room. By computing a dB difference between the near field transfer function measurement and the free field measurement, the influence of the nearby boundaries is determined and a compensation filter is created, in accordance with some embodiments. This can be seen in the example graphs 1030, where the difference between the near field measurement and total sound power presents good correlation in the range of frequencies from 200 Hz to 10 kHz.

Figure 11A:
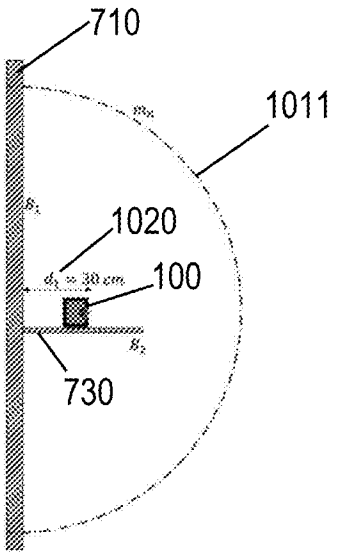
FIG. 11A shows an example of half sphere distribution of microphone positions relative to a loudspeaker with boundaries for a near field microphone, according to some embodiments.
Figure 11B:
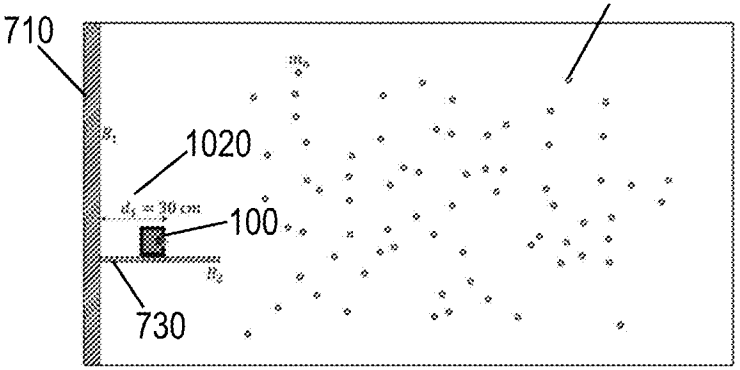
FIG. 11B shows an example of randomly placed microphone positions in a room relative to a loudspeaker and boundaries.

FIG. 11A shows an example of microphone half sphere 1011 horizontal and vertical positions relative to the loudspeaker 100 with boundaries ($B_1$ 710 and $B_2$ 730) for a near field microphone 120 (see, FIGS. 1A-B), according to some embodiments. The distance from the front of the speaker 100 to the boundary $B_1$ 710 is 30 cm. Sound power is measured in 2π space and compared with sound power in room. FIG. 11B shows an example of randomly placed microphone positions 1130 in a room relative to the loudspeaker 100 and boundaries $B_1$ 710 and $B_2$ 730.

Figure 11C:
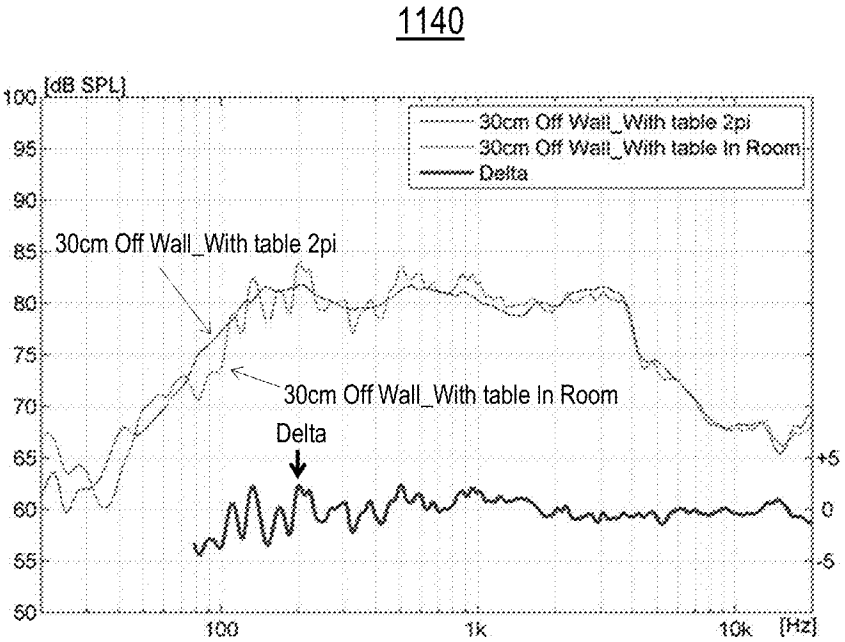
FIG. 11C shows example graphs for sound power measured in a $2\pi$ space compared with sound power in a room, according to some embodiments.

FIG. 11C shows example graphs 1140 for sound power measured in a 2π space compared with sound power in a room, according to some embodiments. It has been found that at frequencies from 200 Hz to 10 kHz, there is a significant correlation between the total sound power measured in a 2π chamber and the energy average of measurements of up to 40 microphones in the room, as shown in the example graph 1140. The total sound power measured in a 2π chamber would give a result similar as to when the speaker is near a back wall. This can provide the opportunity to establish different compensation scenarios when the speaker 100 is in development (e.g., before commercialization). One or more embodiments establish one or more specific scenarios by using pattern recognition on the amplitudes of the reflections and the spacings between them.

In some embodiments, the loudspeaker 100 is placed on a table or inside a shelf, and can be compensated by using the near field measurement and by assessing how many nearby strong reflections from boundaries are present. For example, if the speaker 100 is close to a three-wall corner, the total sound power will show an increment at low frequencies. In one or more embodiments, a compensation filter is added to the speaker 100 to maintain the target total sound power. If the speaker 100 is on a table, an equalization filter is used to compensate for the influence of the sound bouncing on the table. In one or more embodiments, a low Q PEQ (Parametric Equalization Filter) approximately 800 Hz to 1500 Hz is used, depending on the size of the speaker 100 and the distance with respect to the table. In some embodiments, a typical equalization to compensate for one or more nearby boundaries is constructed with second order sections (IIR filters or PEQ) or minimum phase FIR filters.

Figure 12:
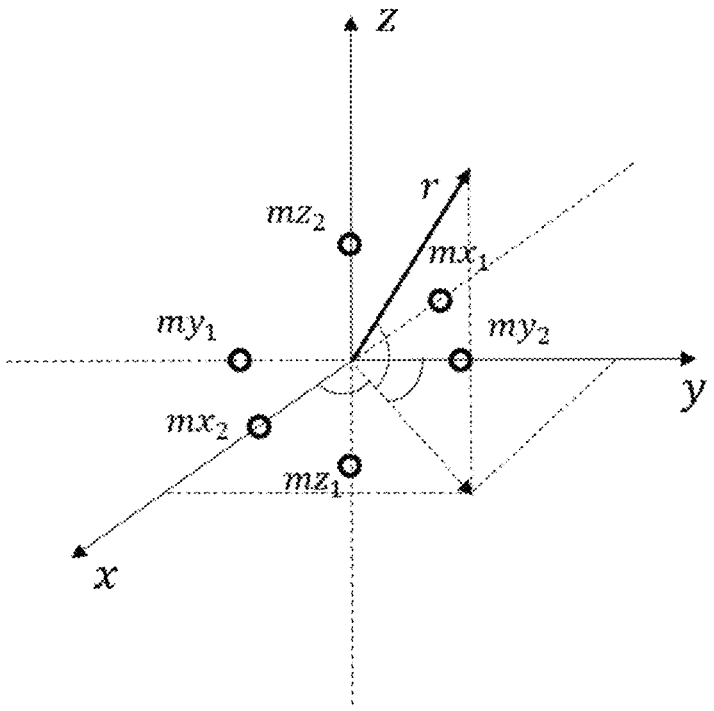
FIG. 12 shows a microphone array coordinate system, according to some embodiments.

FIG. 12 shows a microphone array coordinate system 1200, according to some embodiments. It should be understood that there can be many variations associated with the one or more embodiments. In some embodiments, accuracy with respect to speaker 100 (FIGS. 1A-B) position estimation is improved using a multiple array microphone. The estimation of the direction angle of each reflection is obtained or determined based on the gradient ∇r, described in Eq. 8 of a directional function r=f(x, y, z).

$$\nabla r = \text{grad}r = \left\{\frac{\partial r}{\partial x}(x, y, z), \frac{\partial r}{\partial y}(x, y, z), \frac{\partial r}{\partial z}(x, y, z)\right\} \quad \text{Eq. 8}$$

In some embodiments, the derivative $$\frac{\partial r}{\partial x}$$

in Eq. 9 is the difference in magnitude between microphones $mx_2$ and $mx_1$ placed in the x direction, divided by Δx which is the distance between both transducers. If the estimation of the direction of reflection is necessary only in the 2D plane, only the four microphones $mx_1$, $mx_2$, $my_1$. and $my_2$ are needed. The gradient ∇r in Eq. 12 can be used to compute the direction of the reflection in the x, y plane.

$$\frac{\partial r}{\partial x} = \frac{mx_2 - mx_1}{\Delta x} \quad \text{Eq. 9}$$

$$\frac{\partial r}{\partial y} = \frac{my_2 - my_1}{\Delta y} \quad \text{Eq. 10}$$

$$\frac{\partial r}{\partial z} = \frac{mz_2 - mz_1}{\Delta z} \quad \text{Eq. 11}$$

$$\nabla r = \text{grad}r = \left\{\frac{\partial r}{\partial x}(x, y), \frac{\partial r}{\partial y}(x, y)\right\} \quad \text{Eq. 12}$$

Figure 14:
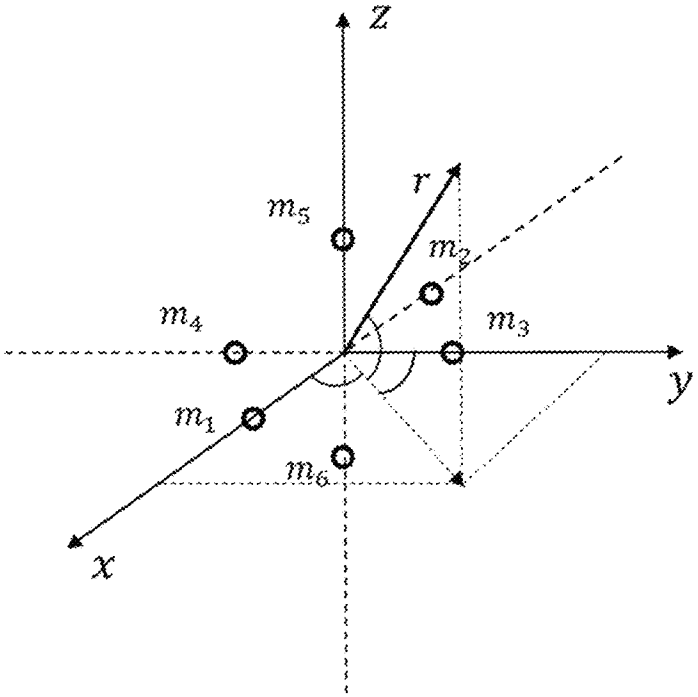
FIG. 14 shows a microphone array coordinate system for a six-microphone setup arrangement, according to some embodiments.
Figure 13:
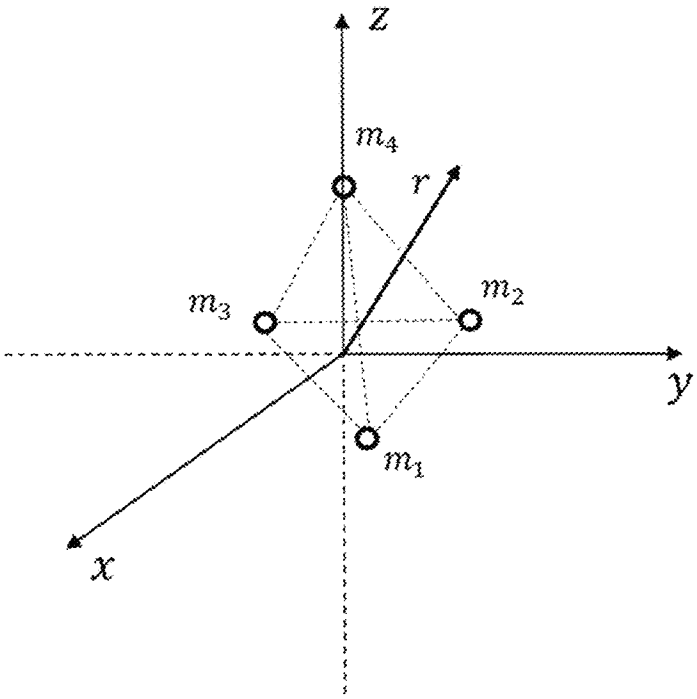
FIG. 13 shows a microphone array coordinate system for a four-microphone setup arrangement, according to some embodiments.

FIG. 13 shows a microphone array coordinate system 1300 for a four-microphone setup arrangement, according to some embodiments. The example four-microphone setup arrangement of FIG. 13 is shown for illustrative purposes. It is contemplated that other variations are possible. FIG. 14 shows a microphone array coordinate system 1400 for a six-microphone setup arrangement, according to some embodiments. The example six-microphone setup arrangement of FIG. 14 is shown for illustrative purposes. Other variations are possible.

FIG. 15 is a block diagram for a process 1500 for autonomous boundary detection for speakers, in accordance with some embodiments. In one embodiment, in block 1510 process 1500 provides for detecting, by a speaker system (e.g., speaker 100, FIGS. 1A-B), one or more boundaries (e.g., a wall, a table, a shelf, a two-wall corner, a three-wall corner, etc.) within a proximity (e.g., near the diaphragm, on a mount, bridge, etc., over the diaphragm, etc.), to the speaker system. In block 1520, process 1500 adjusts, by the speaker system (e.g., using speaker system components processing, a speaker system processor, etc.), an output (e.g., sound signals) of the speaker system based on the one or more detected boundaries. In block 1530, process 1500 improves a sound quality of the speaker system based on adjusting the output.

In some embodiments, process 1500 may provide that detecting the one or more boundaries within the proximity to the speaker system includes computing an IR in a near field associated with the speaker system. Process 1500 may further include determining, based on the IR in the near field, a magnitude, a distance of one or more closest wave reflections, or a combination thereof.

In one or more embodiments, process 1500 may include identifying at least one boundary of the one or more detected boundaries, where the output is adjusted based on the at least one boundary. In some embodiments, process 1500 may include identifying an environment in which the speaker system is situated. The environment may include the one or more detected boundaries. The environment may be identified based on the one or more detected boundaries.

In some embodiments, process 1500 provides that the environment is identified to be one or more of a horizontal surface, a vertical surface, a corner formed by two flat surfaces, or a corner formed by three flat surfaces. Process 1500 may further include determining that the environment has less than a threshold sound quality level in association with the speaker system. An alert (e.g., an audio alert, a graphic or lighting alert (e.g., blinking or flashing light, a particular color light, a vocal alert, an image or graphical display, etc.)) may be provided (or generated, created, etc.) based on the sound quality level.

FIG. 16 is a high-level block diagram showing an information processing system comprising a computer system 1600 useful for implementing various disclosed embodiments. The computer system 1600 includes one or more processors 1601, and can further include an electronic display device 1602 (for displaying video, graphics, text, and other data), a main memory 1603 (e.g., random access memory (RAM)), storage device 1604 (e.g., hard disk drive), removable storage device 1605 (e.g., removable storage drive, removable memory module, a magnetic tape drive, optical disk drive, computer readable medium having stored therein computer software and/or data), user interface device 1606 (e.g., keyboard, touch screen, keypad, pointing device), and a communication interface 1607 (e.g., modem, a network interface (such as an Ethernet card), a communications port, or a PCMCIA slot and card).

The communication interface 1607 allows software and data to be transferred between the computer system 1600 and external devices. The computer system 1600 further includes a communications infrastructure 1608 (e.g., a communications bus, cross-over bar, or network) to which the aforementioned devices/modules 1601 through 1607 are connected.

Information transferred via the communications interface 1607 may be in the form of signals such as electronic, electromagnetic, optical, or other signals capable of being received by communications interface 1607, via a communication link that carries signals and may be implemented using wire or cable, fiber optics, a phone line, a cellular phone link, a radio frequency (RF) link, and/or other communication channels. Computer program instructions representing the block diagrams and/or flowcharts herein may be loaded onto a computer, programmable data processing apparatus, or processing devices to cause a series of operations performed thereon to produce a computer implemented process. In one embodiment, processing instructions for process 1500 (FIG. 15) may be stored as program instructions on the memory 1603, storage device 1604, and/or the removable storage device 1605 for execution by the processor 1601.

Embodiments have been described with reference to flowchart illustrations and/or block diagrams of methods, apparatus (systems), and computer program products. In some cases, each block of such illustrations/diagrams, or combinations thereof, can be implemented by computer program instructions. The computer program instructions when provided to a processor produce a machine, such that the instructions, which executed via the processor create means for implementing the functions/operations specified in the flowchart and/or block diagram. Each block in the flowchart/block diagrams may represent a hardware and/or software module or logic. In alternative implementations, the functions noted in the blocks may occur out of the order noted in the figures, concurrently, etc.

The terms "computer program medium," "computer usable medium," "computer readable medium," and "computer program product," are used to generally refer to media such as main memory, secondary memory, removable storage drive, a hard disk installed in hard disk drive, and signals. These computer program products are means for providing software to the computer system. The computer readable medium allows the computer system to read data, instructions, messages or message packets, and other computer readable information from the computer readable medium. The computer readable medium, for example, may include non-volatile memory, such as a floppy disk, ROM, flash memory, disk drive memory, a CD-ROM, and other permanent storage. It is useful, for example, for transporting information, such as data and computer instructions, between computer systems. Computer program instructions may be stored in a computer readable medium that can direct a computer, other programmable data processing apparatuses, or other devices to function in a particular manner, such that the instructions stored in the computer readable medium produce an article of manufacture including instructions which implement the function/act specified in the flowchart and/or block diagram block(s).

As will be appreciated by one skilled in the art, aspects of the embodiments may be embodied as a system, method or computer program product. Accordingly, aspects of the embodiments may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, aspects of the embodiments may take the form of a computer program product embodied in one or more computer readable medium(s) having computer readable program code embodied thereon.

Any combination of one or more computer readable medium(s) may be utilized. The computer readable medium may be a computer readable storage medium (e.g., a non-transitory computer readable storage medium). A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program code for carrying out operations for aspects of one or more embodiments may be written in any combination of one or more programming languages, including an object oriented programming language such as Java, Smalltalk, C++, or the like, and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

In some cases, aspects of one or more embodiments are described above with reference to flowchart illustrations and/or block diagrams of methods, apparatuses (systems), and computer program products. In some instances, it will be understood that each block of the flowchart illustrations and/or block diagrams, and combinations of blocks in the flowchart illustrations and/or block diagrams, can be implemented by computer program instructions. These computer program instructions may be provided to a special purpose computer, or other programmable data processing apparatus to produce a machine, such that the instructions, which execute via the processor of the computer or other programmable data processing apparatus, create means for implementing the functions/acts specified in the flowchart and/or block diagram block(s).

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block(s).

The computer program instructions may also be loaded onto a computer, other programmable data processing apparatuses, or other devices to cause a series of operational steps to be performed on the computer, other programmable apparatuses, or other devices to produce a computer implemented process such that the instructions which execute on the computer or other programmable apparatuses provide processes for implementing the functions/acts specified in the flowchart and/or block diagram block(s).

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of pre-AIA 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the invention.

Though the embodiments have been described with reference to certain versions thereof; however, other versions are possible. Therefore, the spirit and scope of the appended claims should not be limited to the description of the preferred versions contained herein.

What is claimed is:

1. A method comprising:

detecting, by a speaker system including an enclosure, a diaphragm, and a microphone disposed in proximity of the diaphragm, one or more boundaries within proximity to the speaker system, wherein each detected boundary includes a surface that is outside of the enclosure, wherein the surface reflects sound, and wherein the surface is one of a floor surface, an object surface, or a wall surface;

determining a distance between the diaphragm and at least one boundary of the one or more detected boundaries;

determining a position of the speaker system with respect to the one or more detected boundaries;

autonomously adjusting, by the speaker system, an output of the speaker system based on the determined position and the determined distance; and improving a sound quality of the speaker system based on adjusting the output.

2. The method of claim 1, further comprising:

computing an impulse response (IR) in a near field associated with the speaker system.

3. The method of claim 2, further comprising:

determining, based on the IR in the near field, one or more of a magnitude or a distance of one or more closest wave reflections, wherein the one or more closest wave reflections are from the at least one boundary of the one or more detected boundaries.

4. The method of claim 1, further comprising:

determining sound pressure level differences at the microphone along discrete frequencies; and identifying the at least one boundary of the one or more detected boundaries, wherein:

the determined position of the speaker system with respect to the one or more detected boundaries is determined based on at least one threshold for the sound pressure level differences along discrete frequencies;

the determined position is indicative of one of the following: the speaker system is free standing, the speaker system is within proximity to a wall, the speaker system is within proximity to a two-wall corner, or the speaker system is within proximity to a three-wall corner; and the output is autonomously adjusted based on the at least one boundary.

5. The method of claim 1, further comprising:

identifying an environment in which the speaker system is situated based on the one or more detected boundaries, wherein the environment is one of a horizontal surface outside of the enclosure, a vertical surface outside of the enclosure, a corner formed by two flat surfaces outside of the enclosure, or a corner formed by three flat surfaces outside of the enclosure.

6. The method of claim 1, wherein the microphone is disposed in front of the diaphragm.

7. The method of claim 5, further comprising:

determining that the environment has less than a threshold sound quality level in association with the speaker system; and providing an audio or visual alert in response to determining that the environment has less than the threshold sound quality level in association with the speaker system.

8. A speaker device comprising:

an enclosure;

a speaker driver including a diaphragm;

a microphone disposed in proximity of the diaphragm;

a memory storing instructions; and at least one processor that executes the instructions to:

detect one or more boundaries within proximity to the speaker device, wherein each detected boundary includes a surface that is outside of the enclosure, wherein the surface reflects sound, and wherein the surface is one of a floor surface, an object surface, or a wall surface;

determine a distance between the diaphragm and at least one boundary of the one or more detected boundaries;

determine a position of the speaker device with respect to the one or more detected boundaries;

autonomously adjust an output of the speaker device based on the determined position and the determined distance; and improve a sound quality of the speaker device based on adjusting the output.

9. The speaker device of claim 8, wherein the at least one processor further executes the instructions to:

compute an impulse response (IR) in a near field associated with the speaker device.

10. The speaker device of claim 9, wherein the at least one processor further executes the instructions to:

determine, based on the IR in the near field, one or more of a magnitude or a distance of one or more closest wave reflections, wherein the one or more closest wave reflections are from the at least one boundary of the one or more detected boundaries.

11. The speaker device of claim 8, wherein the at least one processor further executes the instructions to:

determine sound pressure level differences at the microphone along discrete frequencies; and identify the at least one boundary of the one or more detected boundaries, wherein:

the determined position of the speaker device with respect to the one or more detected boundaries is determined based on at least one threshold for the sound pressure level differences along discrete frequencies;

the determined position is indicative of one of the following: the speaker device is free standing, the speaker device is within proximity to a wall, the speaker device is within proximity to a two-wall corner, or the speaker device is within proximity to a three-wall corner; and the output is autonomously adjusted based on the at least one boundary.

12. The speaker device of claim 8, wherein the at least one processor further executes the instructions to:

identify an environment in which the speaker device is situated based on the one or more detected boundaries, wherein the environment is one of a horizontal surface outside of the enclosure, a vertical surface outside of the enclosure, a corner formed by two flat surfaces outside of the enclosure, or a corner formed by three flat surfaces outside of the enclosure.

13. The speaker device of claim 12, wherein the microphone is disposed in front of the diaphragm.

14. The speaker device of claim 12, wherein the at least one processor further executes the instructions to:

determine that the environment has less than a threshold sound quality level in association with the speaker device; and provide an audio or visual alert in response to determining that the environment has less than the threshold sound quality level in association with the speaker device, wherein the microphone comprises one of an individual microphone or a microphone array including a plurality of microphones.

15. A non-transitory processor-readable medium that includes a program that when executed by a processor performs a method comprising:

detecting, by the processor, one or more boundaries within proximity to a speaker system including an enclosure, a diaphragm, and a microphone disposed in proximity of the diaphragm, wherein each detected boundary includes a surface that is outside of the enclosure, wherein the surface reflects sound, and wherein the surface is one of a floor surface, an object surface, or a wall surface;

determining a distance between the diaphragm and at least one boundary of the one or more detected boundaries;

determining, by the processor, a position of the speaker system with respect to the one or detected more boundaries;

autonomously adjusting, by the processor, an output of the speaker system based on the determined position and the determined distance; and improving a sound quality of the speaker system based on adjusting the output.

16. The non-transitory processor-readable medium of claim 15, wherein the method further comprises:

computing an impulse response (IR) in a near field associated with the speaker system.

17. The non-transitory processor-readable medium of claim 16, wherein the method further comprises:

determining sound pressure level differences at the microphone along discrete frequencies;

determining, based on the IR in the near field, one or more of a magnitude or a distance of one or more closest wave reflections; and identifying the at least one boundary of the one or more detected boundaries, wherein:

the one or more closest wave reflections are from the at least one boundary;

the determined position of the speaker system with respect to the one or more detected boundaries is determined based on at least one threshold for the sound pressure level differences along discrete frequencies;

the determined position is indicative of one of the following: the speaker system is free standing, the speaker system within proximity to a wall, the speaker system is within proximity to a two-wall corner, or the speaker system is within proximity to a three-wall corner; and the output is autonomously adjusted based on the at least one boundary.

18. The non-transitory processor-readable medium of claim 15, wherein the method further comprises:

identifying an environment in which the speaker system is situated based on the one or more detected boundaries, wherein the environment is one of a horizontal surface outside of the enclosure, a vertical surface outside of the enclosure, a corner formed by two flat surfaces outside of the enclosure, or a corner formed by three flat surfaces outside of the enclosure.

19. The non-transitory processor-readable medium of claim 18, wherein the microphone is disposed in front of the diaphragm.

20. The non-transitory processor-readable medium of claim 18, wherein the method further comprises:

determining that the environment has less than a threshold sound quality level in association with the speaker system; and providing an audio or visual alert in response to determining that the environment has less than the threshold sound quality level in association with the speaker system.

* * * * *